US006199560B1

(12) United States Patent
North et al.

(10) Patent No.: US 6,199,560 B1
(45) Date of Patent: Mar. 13, 2001

(54) COSMETIC MASK

(75) Inventors: Sue North, 6 Saddle Rock Ter., Great Neck, NY (US) 11023; Hermann Knippscheer, Baldwin, NY (US)

(73) Assignee: Sue North

( * ) Notice: Subject to any disclaimer, the term of this patent is extended or adjusted under 35 U.S.C. 154(b) by 0 days.

(21) Appl. No.: 09/659,033

(22) Filed: Sep. 11, 2000

(51) Int. Cl.[7] ..... A45D 40/30
(52) U.S. Cl. ..... 132/319
(58) Field of Search ..... 132/319, 216, 132/320, 333; 2/15

(56) References Cited

U.S. PATENT DOCUMENTS

| | | | | |
|---|---|---|---|---|
| D. 254,935 | | 5/1980 | Staudinger . | |
| D. 341,001 | | 11/1993 | Pantages . | |
| 3,789,856 | | 2/1974 | Bomba . | |
| 4,033,364 | * | 7/1977 | Inzana et al. | 132/216 |
| 4,807,650 | * | 2/1989 | Bliss | 132/319 |
| 5,050,624 | * | 9/1991 | Kobe et al. | 132/319 |
| 5,052,417 | | 10/1991 | Cordova . | |
| 5,311,888 | | 5/1994 | Leigh . | |
| 5,890,499 | | 4/1999 | Fuentes et al. . | |
| 5,957,142 | * | 9/1999 | Karafilis | 132/319 |

FOREIGN PATENT DOCUMENTS

| | | | | |
|---|---|---|---|---|
| 317816 | * | 8/1929 | (GB) | 132/319 |

* cited by examiner

*Primary Examiner*—Todd E. Manahan
(74) *Attorney, Agent, or Firm*—Natter & Natter

(57) ABSTRACT

A cosmetic mask includes a handle carrying a pad adjacent one end. The pad is formed of a plurality of leaves with a distal edge of each leaf being anatomically contoured with a concave zone to facilitate lateral placement against one's face beneath an eye, the lid of which is to receive makeup. The leaves have a non-gloss outer surface to facilitate adherence of fallen makeup particles. After fallen eye makeup has been collected on the outermost leaf of the pad, the leaf is removed and discarded, leaving a fresh leaf. An alternate embodiment includes a clamp arrangement for mounting the pad to the handle.

20 Claims, 3 Drawing Sheets

COSMETIC MASK

BACKGROUND OF THE INVENTION

1. Field of the Invention

This invention relates generally to the application of cosmetic makeup and more particularly to a cosmetic mask which shields the user's face from eye makeup which has fallen during application.

2. Antecedents of the Invention

A common problem encountered during the application of cosmetic eye makeup such as eye shadow has been the soiling of areas of the face beneath the eye as a result of fallen eye makeup particles.

While numerous devices for shielding one's face during the application of eye makeup have been proposed, none have gained widespread acceptance.

Among the disadvantages of previous eye makeup shields was that they required frequent cleaning for removal of collected makeup. Cleansing was required to be accomplished relatively soon after fallen makeup had been collected on the shield, since the makeup covered surfaces of the shield often contacted clothing and other personal items and tended to smudge the contacted items with makeup. Also, the placement of a shield on a table resulted in the collected makeup particles falling from the shield and onto the support surface.

Further, several prior makeup shields were relatively clumsy and difficult to handle, while others provided a sharp edge which was uncomfortable if not held in exactly the correct position.

BRIEF SUMMARY OF THE INVENTION

A cosmetic mask is configured for lateral placement against a user's face beneath an eye to which makeup is to be applied. The mask includes a handle which supports a mask pad. The pad comprises a plurality of leaves of paper or film having a non-gloss outer surface which facilitates adherence.

The distal edge of each leaf is anatomically contoured with a central convex zone, matching the natural curvature of the face for placement beneath the eye. Each end of the convex zone merges into a concave zone. One concave zone engages the user's nose and the other engages the outer cheekbone area of the user's face to provide intimate gap free contact with the user's face and collect fallen makeup particles.

After makeup has been applied to one eye, the uppermost leaf of the pad, with its collected excess makeup is simply removed from the pad and discarded.

The pad may be configured with opposed back to back arrays of leaves with each array adhered to an opposite face of a base layer. The base panel and/or leaves may be releasably mounted to the handle utilizing a clamp arrangement.

After applying makeup to one eye using the mask, the soiled outermost leaf of one array is removed and the mask is rotated about its longitudinal axis such that the outermost leaf of the lower array is now on top for use when applying makeup to the other eye.

From the foregoing compendium, it will be appreciated that it is an aspect of the present invention to provide a cosmetic makeup mask of the general character described which is not subject to the disadvantages of the antecedents aforementioned.

A feature of the present invention is to provide a cosmetic makeup mask of the general character described which is simple to use.

It is a consideration of the present invention to provide a cosmetic makeup mask of the general character described which is relatively low in cost and suitable for economic mass production fabrication.

Another aspect of the present invention is to provide a cosmetic makeup mask of the general character described which promotes a hygienic environment.

To provide a cosmetic makeup mask of the general character described wherein fallen makeup is collected on leaves which are readily discarded is another feature of the present invention.

A further consideration of the present invention is to provide a cosmetic makeup mask of the general character described which includes an anatomically configured edge surface for gap free engagement against a user's face beneath an eye.

Another aspect of the present invention is to provide a cosmetic makeup mask of the general character described which assures that fallen makeup will not soil one's face.

A still further feature of the present invention is to provide a cosmetic makeup mask of the general character described which assures that collected makeup will not soil clothing.

Another consideration of the present invention is to provide a cosmetic makeup mask of the general character described which facilitates blending of various colors of makeup.

Other aspects, features and considerations of the present invention in part will be obvious and in part will be pointed out hereinafter.

With these ends in view, the invention finds embodiment in certain combinations of elements, arrangements of parts and series of steps by which the aforesaid aspects, features and considerations and certain other aspects, features and considerations are attained, all with reference to the accompanying drawings and the scope of which will be more particularly pointed out and indicated in the appended claims.

BRIEF DESCRIPTION OF THE DRAWINGS

In the accompanying drawings in which are shown some of the various exemplary embodiments of the invention.

DESCRIPTION OF THE PREFERRED EMBODIMENTS

Figure 1:
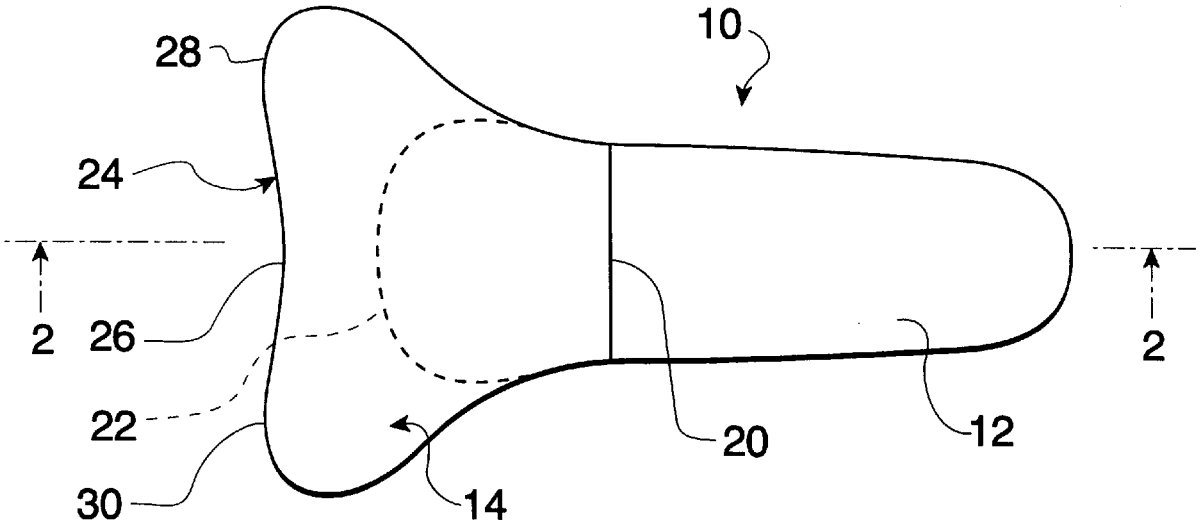
FIG. 1 is a top plan view of a cosmetic mask constructed in accordance with and embodying the invention and illustrating a pad of leaves having an anatomically contoured distal edge with the pad being mounted to a handle adjacent a distal end thereof.

Referring now in detail to the drawings, the reference numeral 10 denotes generally a cosmetic mask constructed in accordance with and embodying the present invention. The mask 10 is configured for lateral placement against a user's face beneath an eye to which makeup is being applied.

The cosmetic mask 10 includes a flat, generally planar, elongate handle 12 formed of a panel of thermoplastic, wood or other suitable material. A pad 14, formed as a stack of generally planar paper thin congruent leaves 16, is mounted to the handle 12.

The lowermost leaf of the pad 14 may be adhered to the upper surface of the handle 12 by a layer of tack adhesive 18. The tack adhesive 18 may be positioned on the underside of each of the successive leaves which form the pad 14. Alternately, the leaves may be joined to one another along a binding or spine 20.

Figure 2:
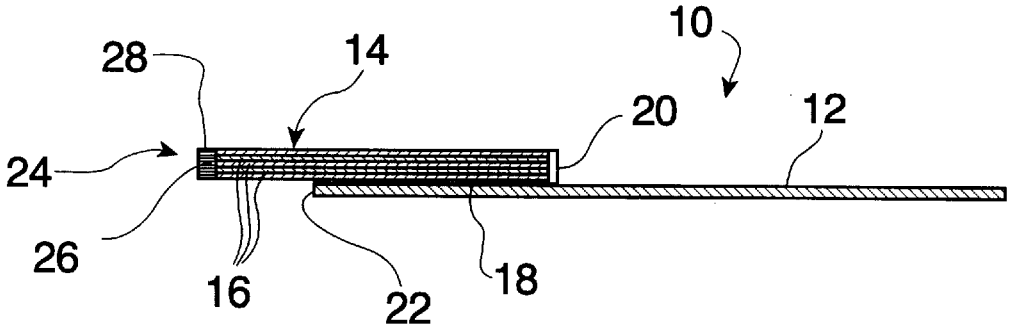
FIG. 2 is a sectional view through the mask, the same being taken substantially along the line 2—2 of FIG. 1 and showing the pad comprising a stack of leaves with a portion of each leaf extending beyond the distal end of the handle.

The pad 14 is positioned relative to the handle 12 such that a distal edge 24 of the pad extends beyond a distal end 22 of the handle, as illustrated in FIGS. 1 and 2.

In accordance with the invention, the distal edge 24 of the pad, i.e. of each of the leaves of the pad 14, is anatomically contoured with a central concave zone 26, configured to matingly contact the contoured surface of the user's face beneath an eye. From opposite ends of the concave zone 26, the distal edge 24 merges into convex zones 28, 30. The convex zone is configured to contact the area of the user's face adjacent the cheekbone and the convex zone 28 configured to contact the area of the user's face adjacent the nose when makeup is being applied to the right eye.

When makeup is being applied to the left eye, the cosmetic mask 10 is so positioned that the convex zone 30 contacts the area of the user's face adjacent the nose and the convex zone 28 contacts the area of the user's face adjacent the cheekbone.

The upper surface of each leaf 16 is configured with a non-gloss texture which promotes adherence of fallen particles of eye makeup. Each leaf 16 is preferably fabricated of paper, including tissue, or may be fabricated of a thin film of polymeric material.

In accordance with the invention, after makeup has been applied to one eye, the uppermost leaf of the pad 14 is removed and the cosmetic mask 10 is placed beneath the user's other eye with a fresh uppermost leaf exposed on the pad 14. Alternately, the uppermost leaf of the pad 14 is discarded after makeup has been applied to both eyes.

A further feature of the invention is that the upper surface of each leaf 16 constitutes a convenient area for employment as a palette in mixing various shades and colors of powdered makeup.

Figure 3:
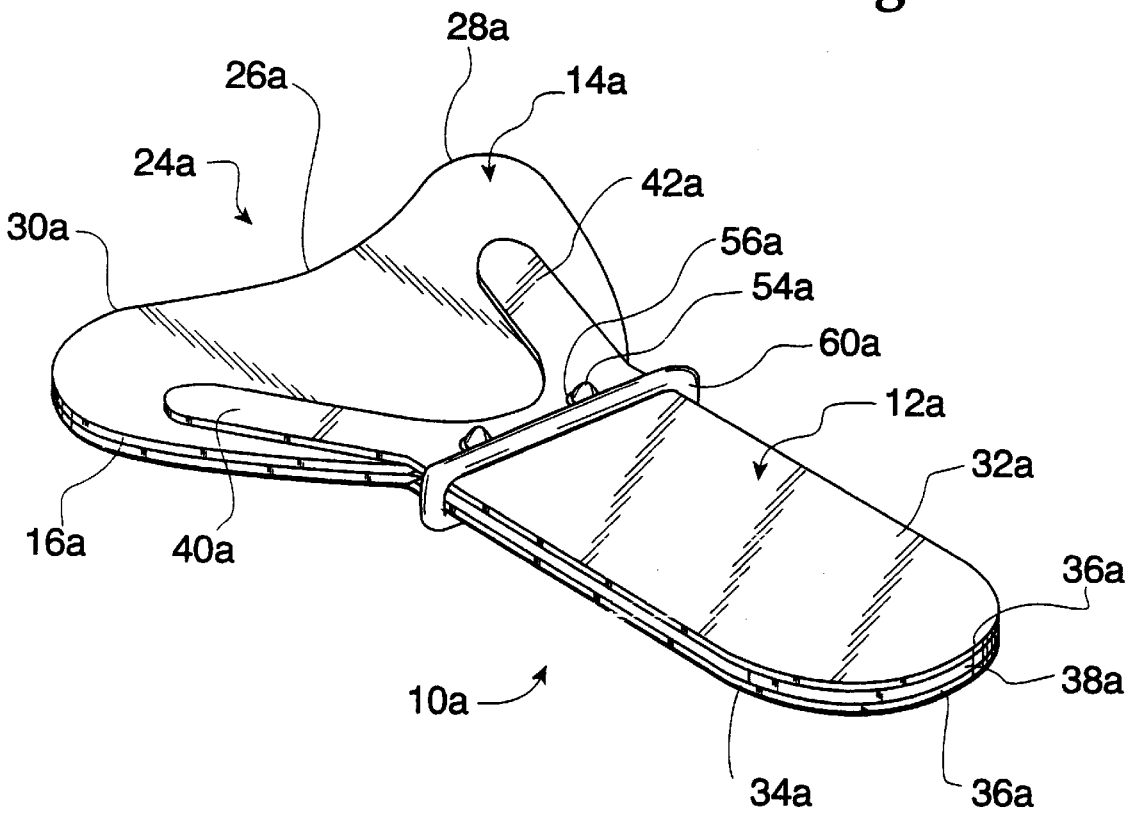
FIG. 3 is a perspective view of an alternate embodiment of the cosmetic mask with a pad of asymmetric plan configuration mounted to a handle formed of a pair of panels through a clamp arrangement.
Figure 4:
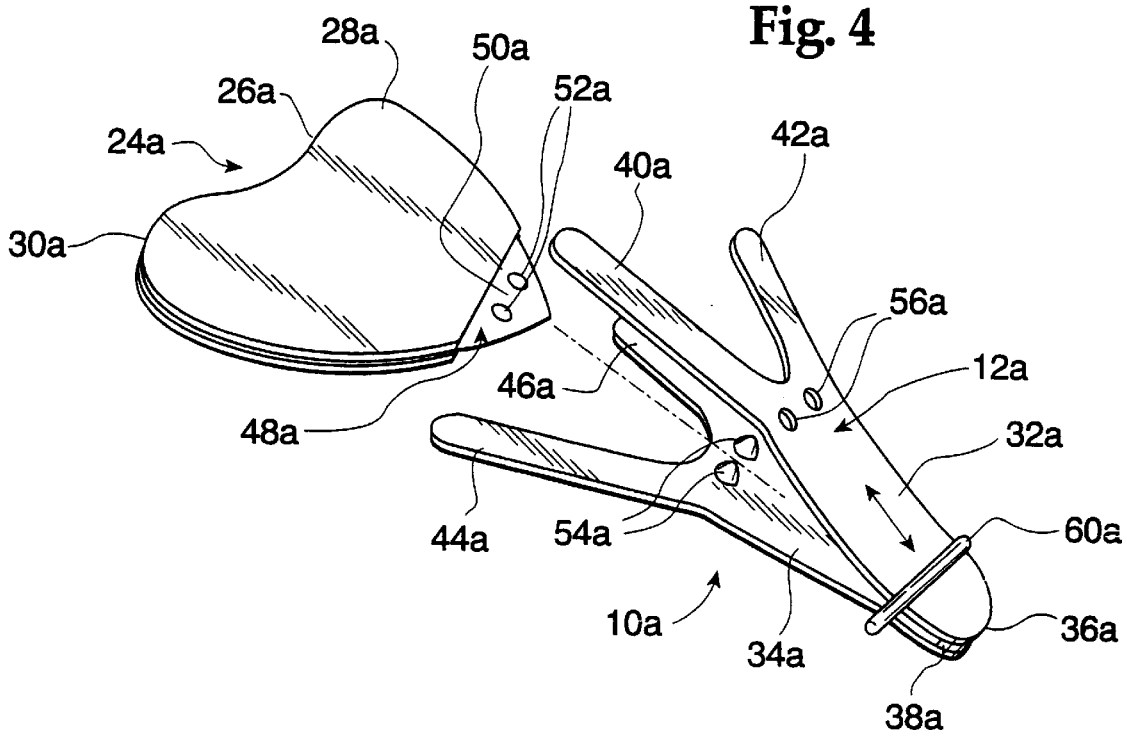
FIG. 4 is an exploded perspective view of the cosmetic mask of FIG. 3 and showing a replacement pad being positioned between jaws of an opened handle for registration with a pair of indexing posts.
Figure 5:
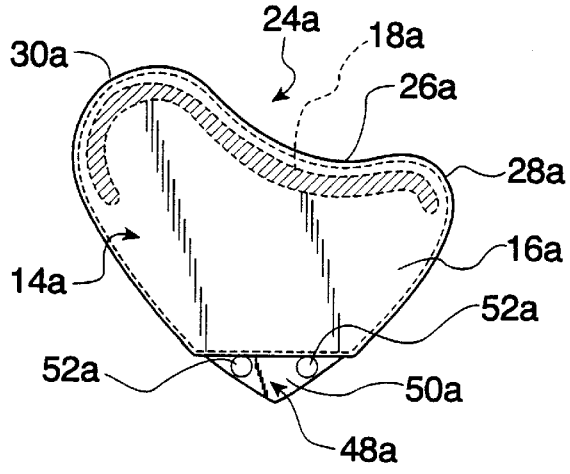
FIG. 5 is a top plan view of the pad of the FIG. 3 embodiment and showing, in dashed lines, the periphery of a base layer and a ribbon of tack adhesive on the underside of each leaf.

Referring now to FIGS. 3–5, wherein an alternate embodiment of the invention is illustrated, like numerals have been employed to denote like components of the prior embodiment, however, bearing the suffix "a". In accordance with the invention, a cosmetic mask 10*a* is formed with a handle 12*a* comprised of a pair of generally planar panels 32*a*, 34*a* each having a rounded proximal end 36*a*. The panels are separated by a spacer 38*a* at their proximal ends.

At the distal end of the handle 12*a*, the panel 32*a* is provided with a pair of diverging jaws, 40*a*, 42*a* while the panel 34*a* is provided with a pair of diverging jaws 44*a*, 46*a*, respectively. Thus the panels 32*a*, 34*a* are configured in a generally wishbone shape.

A pad 14*a* of leaves 16*a* is mounted between the panels 32*a*, 34*a*, in accordance with the invention. As will be noted from an examination of FIG. 3, the pad 14*a* includes an anatomically contoured distal edge 24*a* which extends an axial distance beyond the ends of the jaws 40*a*, 42*a*, 44*a* and 46*a* to thus provide a surface on the uppermost leaf for collecting excess fallen makeup.

It is significant that a jaws 40*a*, 42*a* are oriented with respect to one another in a generally "V" shaped plan configuration such that a large central open surface area of exposed leaf is provided. The jaws 40*a*, 42*a*, 44*a* and 46*a* also serve to support the leaves of the pad.

The distal edge 24*a* is configured with a central concave portion 26*a* which merges, at one end, with a convex portion 28*a*. The other end of the concave portion 26*a* merges into a larger diameter convex portion 30*a*. Such that the pad 14*a* is asymmetric in plan configuration, unlike the pad 14 of the prior embodiment.

The smaller diameter convex portion 28*a* is configured to be placed adjacent the user's nose while the larger diameter convex portion 30*a* is configured for placement against the user's cheekbone. As such, the cosmetic mask 10*a* in the orientation depicted in FIG. 3, is only suitable for employment when makeup is being applied to one's right eye.

It should be noted, however, that the pad 14*a* is configured with back to back arrays of leaves mounted to a central base layer 48*a*, the base layer 48*a* is less pliant than the leaves 16*a*. The cosmetic mask 10*a* may be flipped over about its longitudinal axis to have, as its uppermost leaf available for catching fallen makeup, the leaf which was previously the downwardly facing lowermost leaf to thus be configured for placement beneath the user's left eye.

It should also be noted that the base layer 48*a* includes a tail portion 50*a* which projects beyond the leaves 16*a* and which includes a pair of apertures 52*a* suitable, for indexing engagement upon a pair of rounded posts 54*a* which project from the plane of the panel 34*a* into sockets 56*a* formed in the panel 32*a*. The posts serve to facilitate positioning of the pad during assembly as will be explained in detail hereinafter. It should be appreciated that the posts 54*a*, the apertures 52*a* and the sockets 56*a* need not be circular in transverse cross section.

It should also be noted that in order to replace the pad 14*a* or remove a leaf 16*a* from the pad 14*a*, the panels 32*a*, 34*a* are separated at their distal ends. This is accomplished by sliding a retaining ring 60*a*, which circumscribes the panels, from a locked position, adjacent the sockets 56*a*, as illustrated in FIG. 3 to an open position, adjacent the spacer 36*a*, as illustrated in FIG. 4. The posts 54*a* serve to retain the pad in proper position during this procedure. The "V" configuration of the jaws facilitates easy removal of soiled leaves by providing a central open surface terminating at the vertex of the jaws for grasping the uppermost leaf between one's fingers.

In FIG. 5 there is illustrated a plain view of a typical pad 14*a* and showing in a dashed line, the periphery of the base layer 48*a* which is covered by successive leaves 16*a*. There is also shown in FIG. 5, in dashed lines, a ribbon of tack adhesive 18*a* applied to the undersurface of each pad adjacent the distal edge thereof.

The layer of tack adhesive 18*a* serves to retain the stack of leaves together until such time as an outermost leaf is discarded. To discard a soiled leaf 16*a*, the panels may be separated by sliding the ring 60*a* to its FIG. 4 position. Alternately, the soiled leaf may be simply pulled from the pad without separating the panels 32*a*, 34*a*.

Thus it will be seen that there is provided a cosmetic mask which achieves the various aspects, features and considerations of the present invention and which is well suited to meet the conditions of practical usage.

Since various changes may be made in the illustrative embodiments herein disclosed without departing from the spirit of the invention, it is to be understood that all matter herein described or shown in the accompanying drawings is to be interpreted as illustrative and not in a limiting sense.

Having thus described the invention, there is claimed as new and desired to be secured by Letters Patent:

1. A cosmetic mask for shielding a user's face from cosmetic makeup particles which have inadvertently fallen during the application of eye makeup, the cosmetic mask comprising a handle, a pad formed of a plurality of leaves, the pad being positioned adjacent a distal end of the handle, each leaf having an anatomically contoured distal edge, the distal edges including a concave zone configured for lateral placement against a user's face beneath an eye, whereby a leaf with collected makeup particles may be removed from the pad and discarded.

2. A cosmetic mask for shielding a user's face as constructed in accordance with claim 1 wherein the leaves are congruent.

3. A cosmetic mask for shielding a user's face as constructed in accordance with claim 1 wherein the leaves include a non-gloss surface to facilitate adherence of fallen makeup particles.

4. A cosmetic mask for shielding a user's face as constructed in accordance with claim 1 wherein the leaves are formed of tissue.

5. A cosmetic mask for shielding a user's face as constructed in accordance with claim 1 wherein the leaves are joined to one another by a strippable tack adhesive.

6. A cosmetic mask for shielding a user's face as constructed in accordance with claim 1 wherein the handle includes a proximal end and a distal end, the distal edges of each leaf being positioned in an axial direction beyond the distal end of the handle.

7. A cosmetic mask for shielding a user's face as constructed in accordance with claim 1 wherein the pad includes a generally planar base layer, a first plurality of leaves overlying one face of the base layer and a second plurality of leaves overlying the opposite face of the base layer whereby after collecting makeup on an outermost leaf of the first plurality, the mask is rotated about a longitudinal axis to present an outermost leaf of the second plurality for use in collecting makeup.

8. A cosmetic mask for shielding a user's face as constructed in accordance with claim 7 wherein the base layer is less pliant than the leaves.

9. A cosmetic mask for shielding a user's face as constructed in accordance with claim 7 wherein the leaves are asymmetric.

10. A cosmetic mask for shielding a user's face as constructed in accordance with claim 1 wherein the leaves are asymmetric.

11. A cosmetic mask for shielding a user's face as constructed in accordance with claim 1 wherein the pad is adhesively secured to the handle.

12. A cosmetic mask for shielding a user's face as constructed in accordance with claim 1 wherein the handle is generally planar.

13. A cosmetic mask for shielding a user's face as constructed in accordance with claim 1 wherein the pad is clamped.

14. A cosmetic mask for shielding a user's face as constructed in accordance with claim 13 wherein the handle comprises a pair of panels each having a proximal end and a distal end, the panels being releasably biased toward one another adjacent the distal end of each panel, at least a portion of the pad being positioned between the panels at the distal end of each panel.

15. A cosmetic mask for shielding a user's face as constructed in accordance with claim 14 further including at least one indexing post extending from the plane of one panel and the pad including an aperture receiving the indexing post.

16. A cosmetic mask for shielding a user's face as constructed in accordance with claim 15 wherein the pad includes a generally planar base layer and a plurality of leaves overlying the base layer, the aperture receiving the indexing projection extending through the base layer.

17. A cosmetic mask for shielding a user's face from cosmetic makeup particles which have inadvertently fallen during the application of eye makeup, the cosmetic mask comprising a handle, a pad positioned adjacent a distal end of the handle, the pad including a generally planar base layer and a plurality of leaves overlying the base layer, the base layer being less pliant than the leaves, each leaf having an anatomically contoured distal edge configured for lateral placement against a user's face beneath an eye, each leaf including a non-gloss surface to facilitate adherence of fallen makeup particles, a leaf with collected makeup particles being removable from the pad.

18. A cosmetic mask for shielding a user's face from cosmetic makeup particles which have inadvertently fallen during the application of eye makeup as constructed in accordance with claim 17 wherein the leaves are joined to one another by a strippable tack adhesive.

19. A cosmetic mask for shielding a user's face from cosmetic makeup particles which have inadvertently fallen during the application of eye makeup as constructed in accordance with claim 17 wherein the leaves are congruent.

20. A method of applying eye makeup without soiling one's face with fallen makeup particles, the method comprising the steps of:

(a) providing a cosmetic mask as constructed in accordance with claim 17, (b) grasping the handle in one hand, (c) laterally moving the mask until the distal edge of an outermost leaf of the pad contacts the user's face beneath an eye, (d) applying eye makeup with the other hand while collecting fallen makeup particles on the outermost leaf, (e) removing the mask after completing the application of eye makeup, and (f) removing the outermost leaf from the pad.

* * * * *